US011326391B2

(12) United States Patent
Luvison

(10) Patent No.: US 11,326,391 B2
(45) Date of Patent: May 10, 2022

(54) WINDOW ASSEMBLY

(71) Applicant: Associated Materials, LLC, Cuyahoga Falls, OH (US)

(72) Inventor: Michael Luvison, Cuyahoga Falls, OH (US)

(73) Assignee: Associated Materials, LLC, Cuyahoga Falls, OH (US)

( * ) Notice: Subject to any disclaimer, the term of this patent is extended or adjusted under 35 U.S.C. 154(b) by 0 days.

(21) Appl. No.: 17/102,089

(22) Filed: Nov. 23, 2020

(65) Prior Publication Data

US 2021/0246717 A1 Aug. 12, 2021

Related U.S. Application Data

(60) Provisional application No. 62/970,939, filed on Feb. 6, 2020.

(51) Int. Cl.
*E06B 3/54* (2006.01)
*E06B 3/58* (2006.01)
(Continued)

(52) U.S. Cl.
CPC ..... *E06B 3/9684* (2013.01); *E06B 3/20* (2013.01); *E06B 3/5409* (2013.01);
(Continued)

(58) Field of Classification Search
CPC ..... E06B 3/54; E06B 3/5409; E06B 3/5481; E06B 3/58; E06B 3/5821; E06B 3/5885;
(Continued)

(56) References Cited

U.S. PATENT DOCUMENTS 2,497,515 A * 2/1950 Pearse ..... E06B 3/56 52/DIG. 1
2,617,159 A * 11/1952 Leighton ..... E06B 3/5409 52/204.593

(Continued)

FOREIGN PATENT DOCUMENTS

FR 2668579 A1 * 4/1992 ..... E06B 3/5409

*Primary Examiner* — Ryan D Kwiecinski
(74) *Attorney, Agent, or Firm* — Knobbe, Martens, Olson & Bear LLP

(57) ABSTRACT

A polymer window assembly includes a polymer window frame with a pair of jambs and a sill, and a glass unit carried by the window frame. A pair of brackets are attached to the jambs proximate corners between the jambs and the sill. Each bracket has an upright member, a horizontal member orthogonal to the upright member and a hook attached to a rear surface of the upright member. The brackets attach to the jambs so that the hook extends through a hole in the jamb, the upright member is adjacent a surface of the jamb and the horizontal member is disposed above (e.g., spaced above) the sill. The brackets support and transfer the weight of the glass unit to the jambs to inhibit (e.g., prevent) the sill from bearing the load of the glass unit, thereby inhibiting (e.g., preventing) the crushing or bowing of the sill by the glass unit and thereby inhibiting (e.g., preventing) the formation of gaps in the window assembly that allow for air and/or water infiltration through the window assembly.

20 Claims, 8 Drawing Sheets

(51) Int. Cl.

| | |
|---|---|
| ***E06B 3/96*** | (2006.01) |
| ***E06B 3/968*** | (2006.01) |
| ***E06B 3/964*** | (2006.01) |
| ***E06B 3/20*** | (2006.01) |

(52) U.S. Cl.
CPC ..... *E06B 3/5481* (2013.01); *E06B 3/5821* (2013.01); *E06B 3/9641* (2013.01); *E06B 3/9644* (2013.01)

(58) Field of Classification Search
CPC ..... E06B 3/96; E06B 3/964; E06B 3/9684; E06B 3/20; E06B 3/9641; E06B 3/9644
See application file for complete search history.

(56) References Cited

U.S. PATENT DOCUMENTS

| | | | | | |
|---|---|---|---|---|---|
| 2,854,709 | A * | 10/1958 | Hirtz | E06B 3/5409 | 411/522 |
| 3,404,501 | A * | 10/1968 | Von Wedel | E06B 3/5409 | 52/204.64 |
| 2017/0254139 | A1* | 9/2017 | Braid | E06B 3/5409 | |
| 2020/0270861 | A1* | 8/2020 | Bartella | E04B 9/0435 | |
| 2021/0198938 | A1* | 7/2021 | Pedersen | E06B 3/54 | |

* cited by examiner

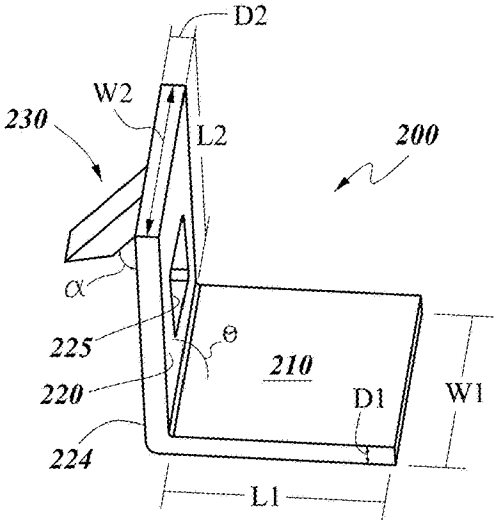
FIG. 8A
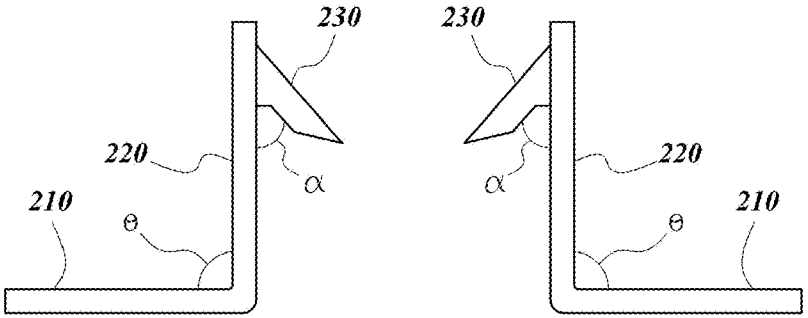
FIG. 8B
FIG. 8C
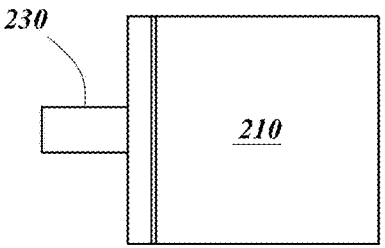
FIG. 8D
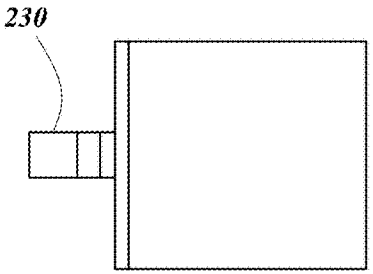
FIG. 8E
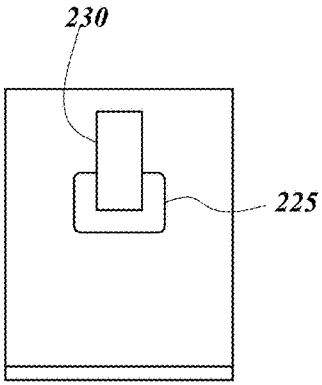
FIG. 8G
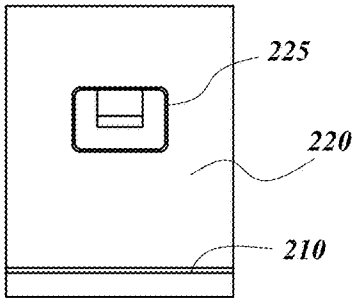
FIG. 8F

WINDOW ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND

Field

Aspects of the present disclosure are directed to a window assembly, and more particularly to a window assembly that utilize brackets to support a load of the glass in the window assembly and transfer the load to the jambs of the window assembly.

Description of the Related Art

Windows assemblies include a frame and a glass unit (e.g., insulated glass unit or IGU). The window frame can be made from wood, metal, polymers (e.g., vinyl), or a variety of combinations of these materials. As the size of windows increases, the weight of the window increases (e.g., to 300-350 lbs.). The increased weight can in some instances lead to the glass unit causing the sill of a polymer (e.g., vinyl) window assembly to bow or be crushed, which can result in gaps in the window assembly that allow for air and water infiltration, requiring replacement of the window and possible repairs to the window opening (e.g., in a stucco home). Also, high temperature exposure of window assemblies (e.g., exposures to temperatures of 175-180 degrees Fahrenheit due to ambient and reflected sunlight in the Southwest United States) can weaken the sill of a polymer (e.g., vinyl) window, allowing for the weight of the window to crush or bow the sill of the window assembly. In still other instances, handling of heavy window assemblies with polymer frames (e.g., lifting of window assemblies for installation in upper floors of a building or home) can cause the weight of the glass unit to crush or bow the sill.

SUMMARY

Accordingly, there is a need for an improved polymer (e.g., vinyl) window assembly that inhibits (e.g., prevents) the bowing (e.g., sagging) or crushing of the sill of the window assembly (e.g., due to the weight of the glass unit of the window assembly and/or the high temperature environment in which the window assembly is used) and the generation of gaps in the window assembly that allow in air and/or water infiltration through the window assembly.

In accordance with one aspect of the invention, a polymer window assembly is provided. The window assembly includes a window frame made of a polymer material (e.g., polyvinyl chloride or vinyl) and a glass unit (e.g., a single pane of glass, two or more panes of glass in an insulated glass unit) carried by the window frame. The window frame includes a pair of jambs (e.g., vertical members) and a sill (e.g., horizontal member) at a bottom of the window assembly that interconnects the pair of jambs. The window assembly further includes a pair of brackets, each having an upright member, a horizontal member orthogonal to the upright member and a hook attached to a rear surface of the upright member. Each of the pair of brackets is attached to one of the pair of jambs proximate a corner between the jamb and the sill so that the hook extends through a hole in the jamb, the upright member is adjacent a surface of the jamb and the horizontal member is disposed above the sill. Optionally the horizontal member is spaced above the sill (e.g., such that the horizontal member is not in contact with the sill). The pair of brackets receive and support corners of the glass unit (e.g., so that the corner of the glass unit sits on the horizontal member and adjacent the upright member of the brackets). The pair of brackets support the load (e.g., substantially all of the weight, all of the weight) of the glass unit and transfer the load to the pair of jambs of the window assembly. The pair of brackets inhibit (e.g., prevent) the load (e.g., a substantial portion of the load, a majority of the load, substantially all of the load, the entire load) of the glass unit (e.g., insulated glass unit) from bearing on the sill, thereby inhibiting (e.g., preventing) the crushing or bowing (e.g., sagging) of the sill and thereby inhibiting (e.g., preventing) the formation of gaps in the window assembly that allow for air and/or water infiltration through the window assembly.

In accordance with another aspect of the invention, a bracket for use in a window assembly is provided. The bracket includes an upright member, a horizontal member orthogonal to the upright member and a hook attached to a rear surface of the upright member. The bracket is configured to be attached to a jamb of the window assembly proximate a corner between the jamb and a sill of the window assembly so that the hook extends through a hole in the jamb, the upright member is adjacent a surface of the jamb and the horizontal member is disposed above the sill. The bracket is configured to be installed on the jamb so that the horizontal member is spaced above the sill (e.g., such that the horizontal member is not in contact with the sill). The bracket is configured to receive and support a corner of the glass unit of the window assembly (e.g., so that the corner of the glass unit sits on the horizontal member and adjacent the upright member of the bracket). The bracket is configured to support the load of the glass unit and transfer the load to the jamb of the window assembly. The bracket inhibits (e.g., prevents) the load (e.g., a substantial portion of the load, a majority of the load, substantially all of the load, the entire load) of the glass unit (e.g., insulated glass unit) from bearing on the sill, thereby inhibiting (e.g., preventing) the crushing or bowing (e.g., sagging) of the sill and thereby inhibiting (e.g., preventing) the formation of gaps in the window assembly that allow for air and/or water infiltration through the window assembly.

BRIEF DESCRIPTION OF THE DRAWINGS

FIG. 8A is a perspective view of a bracket.

FIG. 8B is a left side view of the bracket of FIG. 8A.

FIG. 8C is a right side view of the bracket of FIG. 8A.

FIG. 8D is a top view of the bracket of FIG. 8A.
FIG. 8E is a bottom view of bracket of FIG. 8A.
FIG. 8F is a front view of the bracket of FIG. 8A.
FIG. 8G is a rear view of the bracket of FIG. 8A.

DETAILED DESCRIPTION

Figure 1:
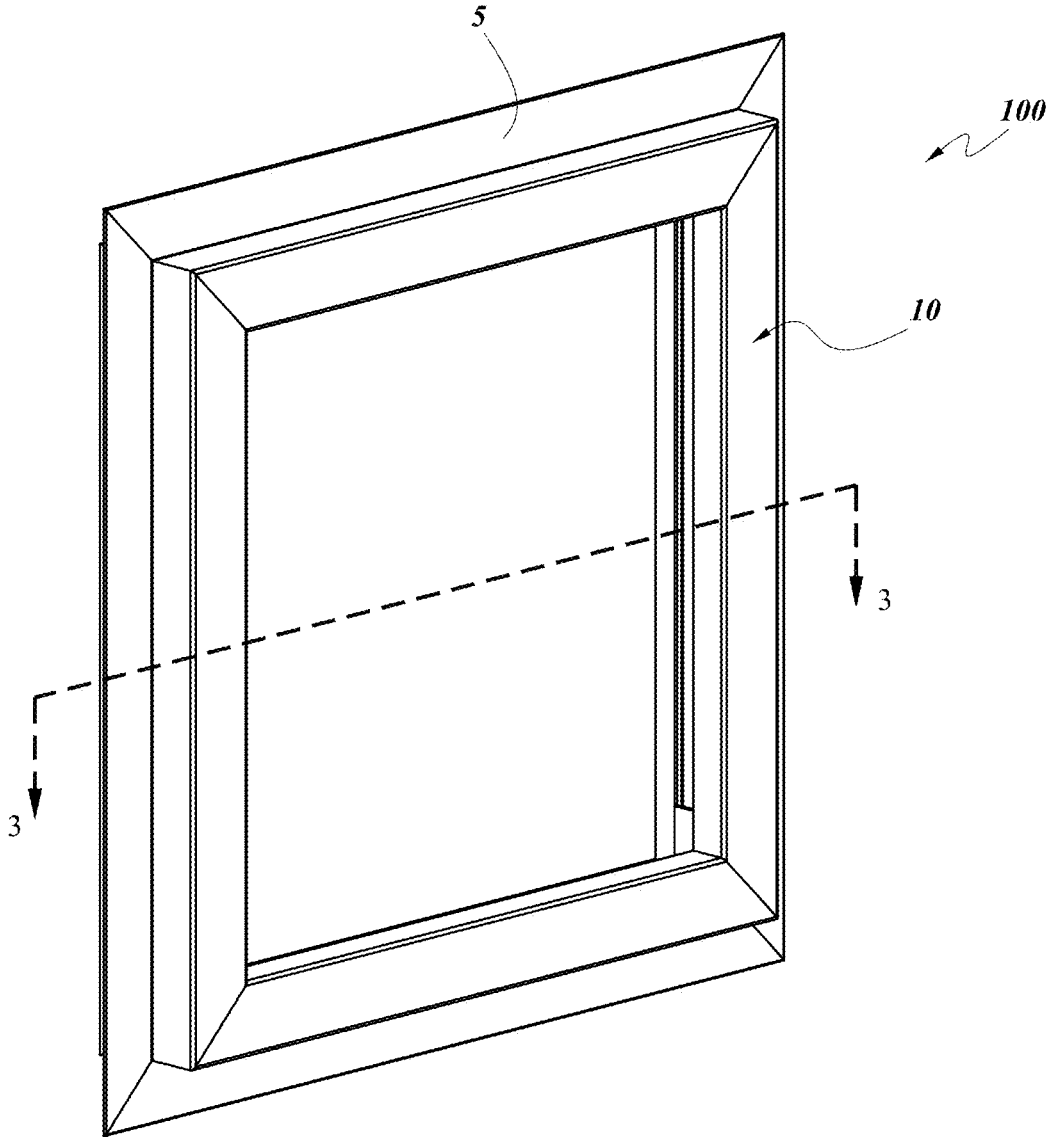
FIG. 1 is a perspective view of a window assembly.
Figure 2:
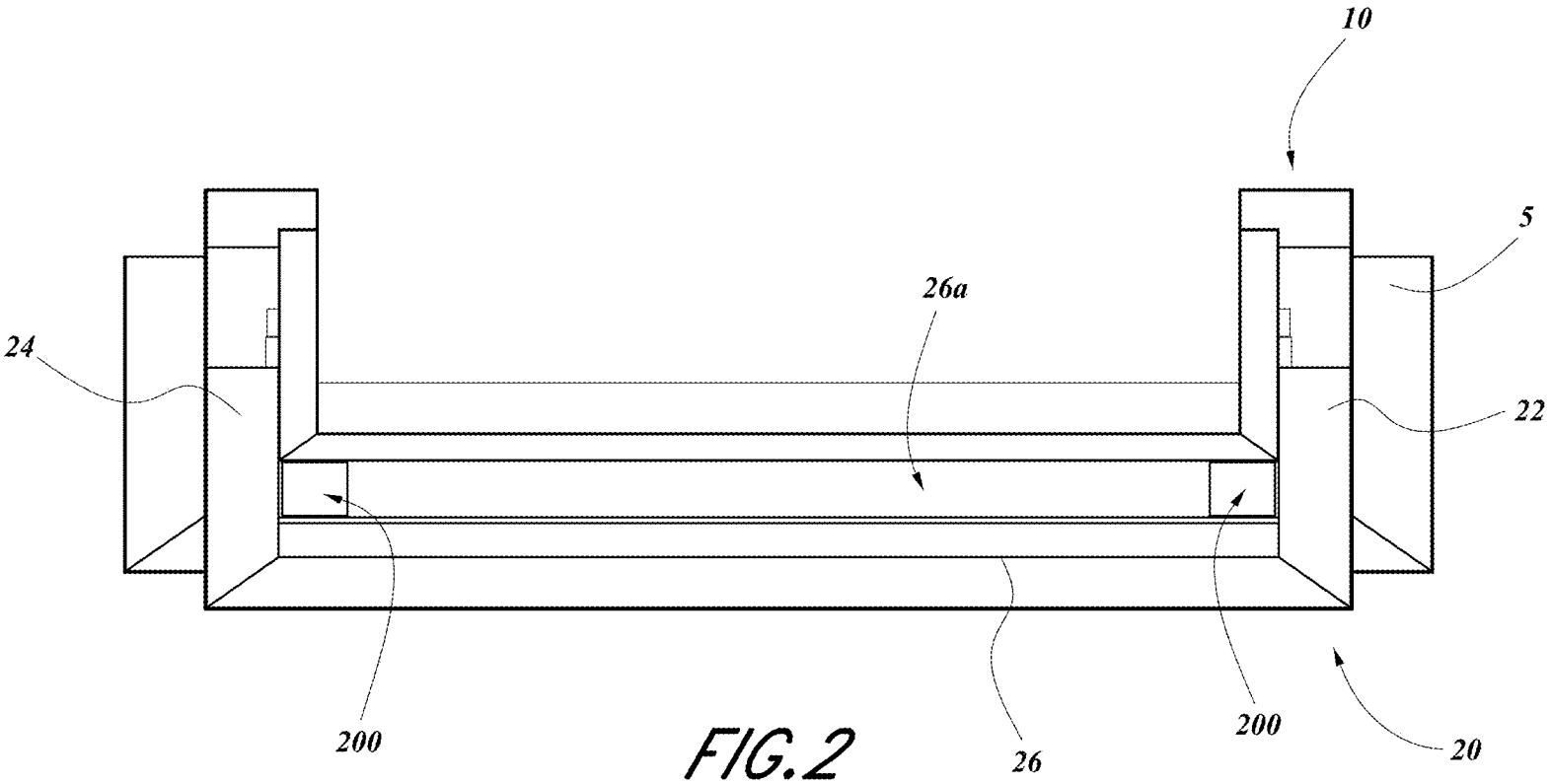
FIG. 2 is a partial cross-sectional view of the window assembly of FIG. 1.
Figure 3:
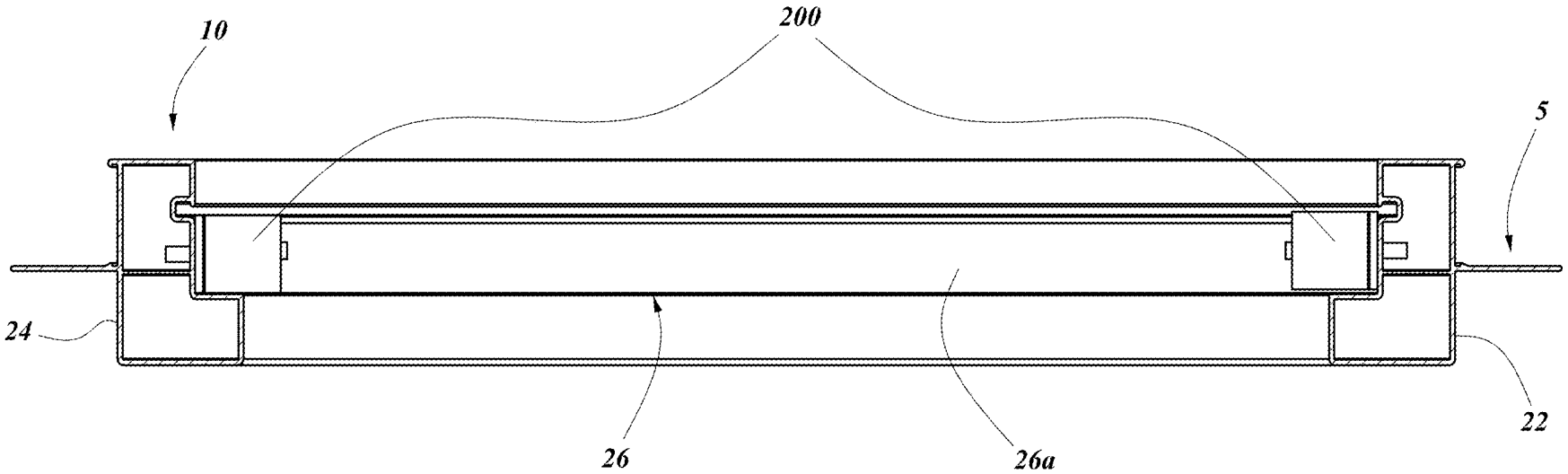
FIG. 3 is a cross-sectional view of the window assembly, as taken along section line 3-3 in FIG. 1.
Figure 4:
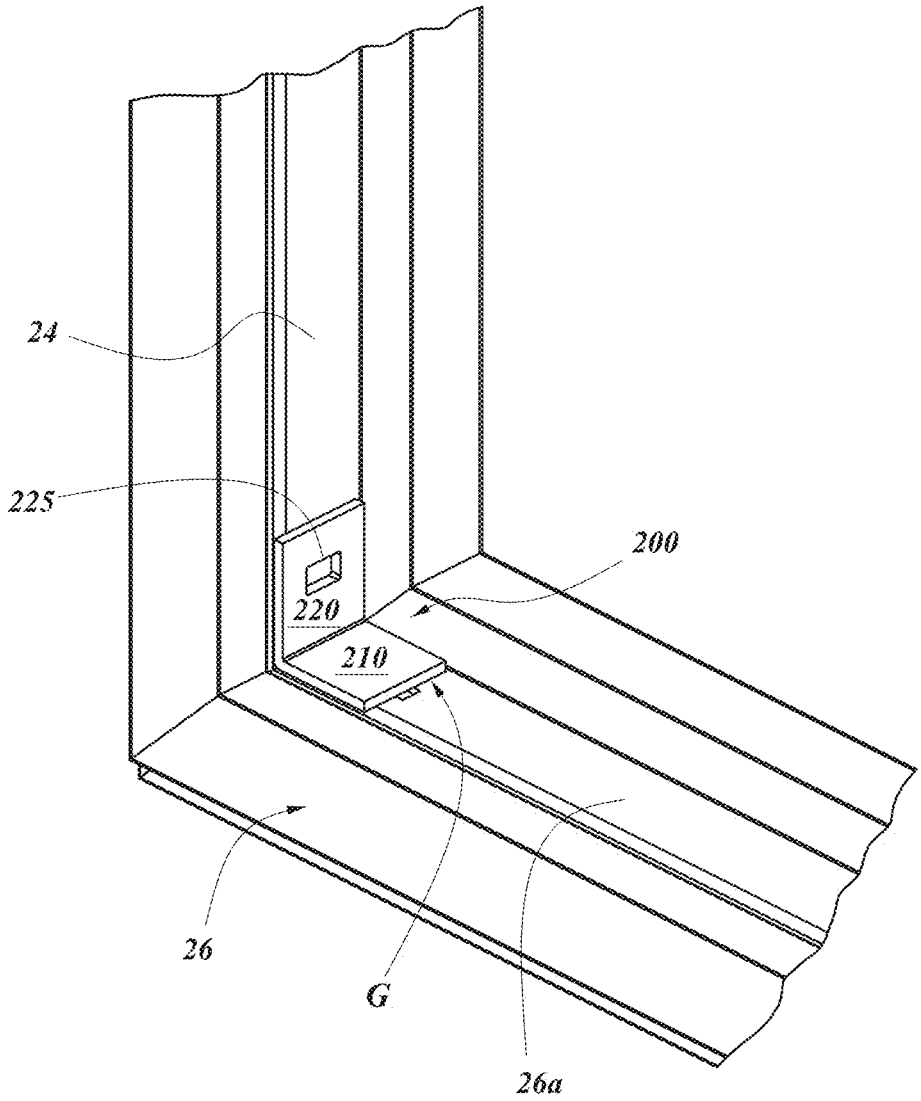
FIG. 4 is an enlarged sectional view of a portion of the window assembly in FIG. 1, excluding the glass unit.
Figure 5:
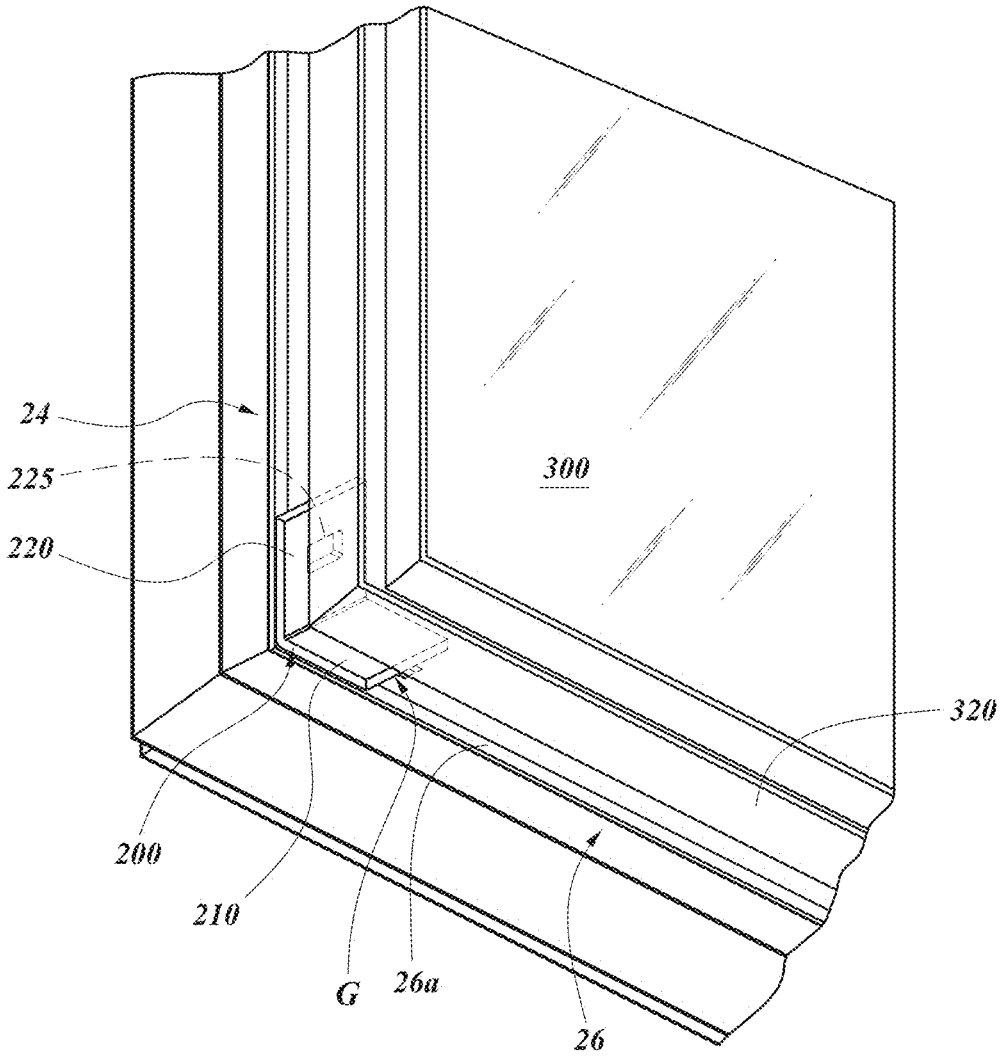
FIG. 5 is an enlarged sectional view of a portion of the window assembly in FIG. 1, including the glass unit.
Figure 6:
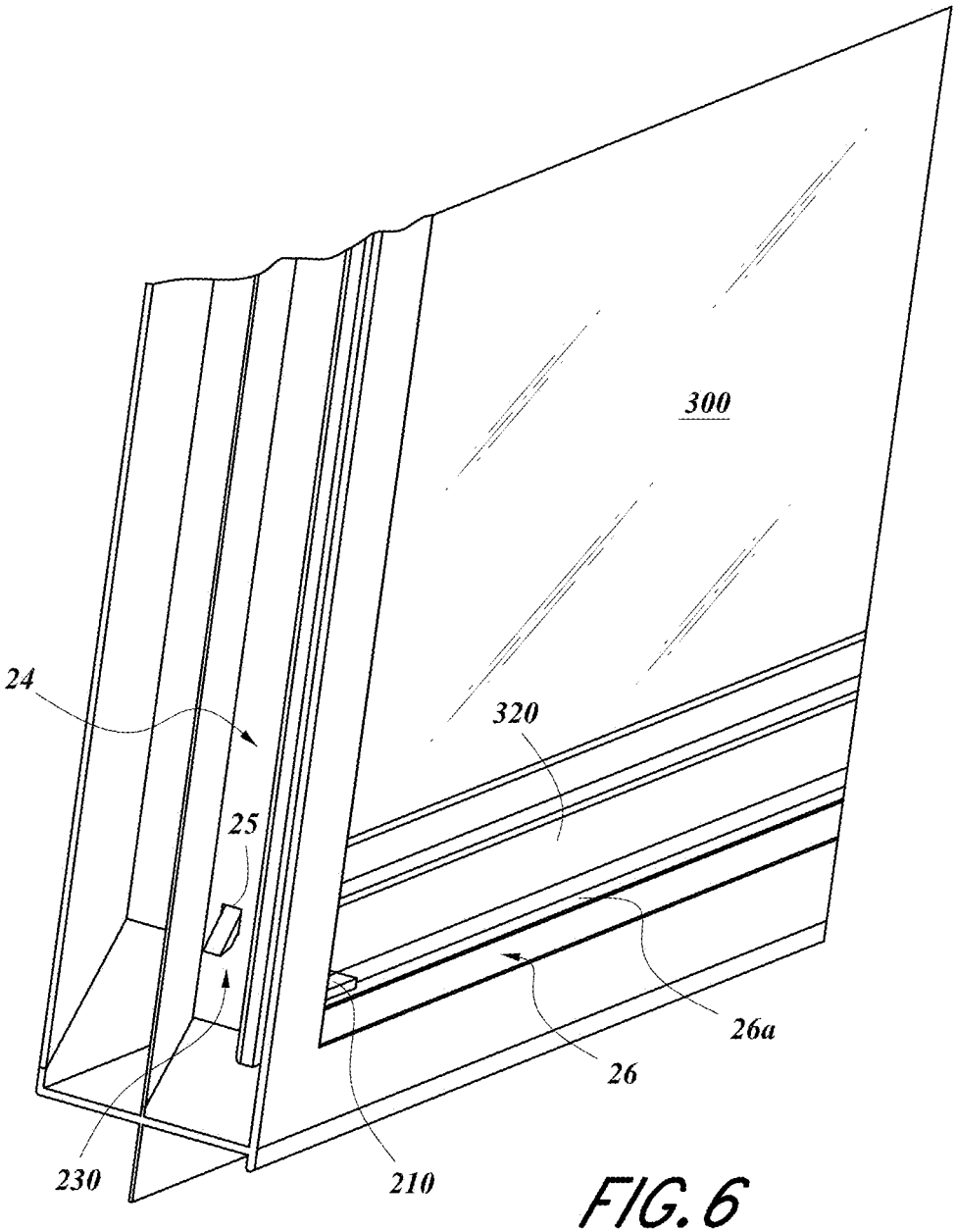
FIG. 6 is an enlarged sectional view of a portion of the window assembly of FIG. 1.
Figure 7:
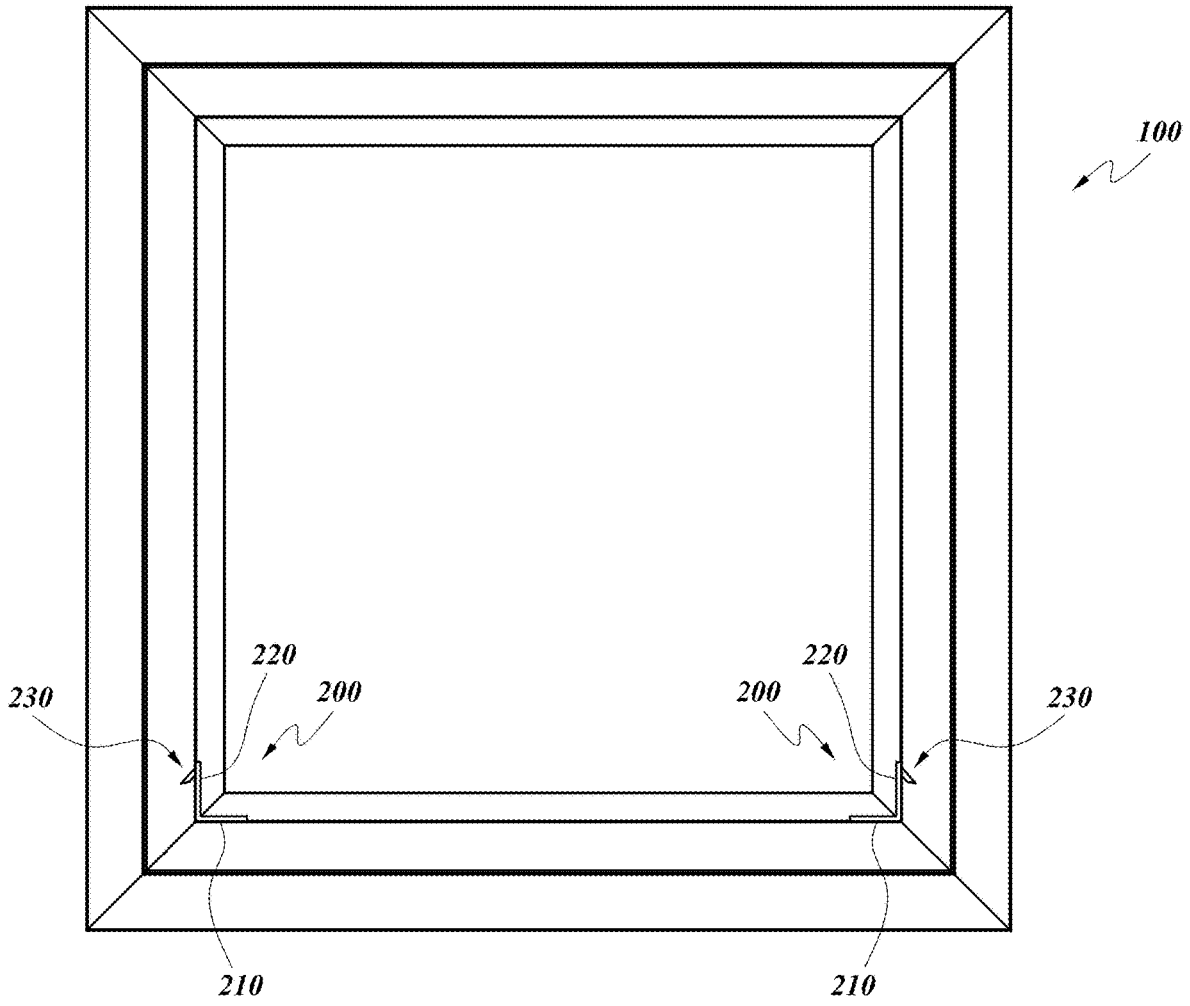
FIG. 7 is a cross-sectional view of the window assembly of FIG. 1.

FIGS. 1-7 show a window assembly 100 with a nail fin 5, a first (e.g., front) frame portion 10 and a second (e.g., rear) frame portion 20 on opposite sides of the nail fin 5. The second frame portion 20 includes a pair of jambs 22, 24 and a sill 26 with a top surface 26*a* and extending between and interconnecting the pair of jambs 22, 24. The pair of jambs 22, 24 can be parallel to each other. The sill 26 can extends generally orthogonal (e.g., perpendicular) to the jambs 22, 24 and interconnect with the jambs 22, 24 at corners of the window assembly 100 (e.g., at corners of the second frame portion 20).

The frame (e.g., the first frame portion 10, the second frame portion 20) of the window assembly 100 can be made of a polymer material (e.g., polyvinyl chloride or vinyl). The frame can carry a glass unit 300 (see FIG. 5). The glass unit 300 can include one or more panes (e.g., two panes, three panes) of glass (e.g., in an insulated glass unit) and can include a glazing bead 320 (e.g., of rubber) about the panes of glass.

As shown, for example, in FIGS. 4-7, a pair of brackets 200 can be attached to the jambs 22, 24 at or near corners between the jambs 22, 24 and the sill 26. Optionally, the brackets 200 can be made of a polymer material (e.g., vinyl). With reference to FIGS. 8A-8G, each of the brackets 200 has an upright member 220, a horizontal member 210 that extends at an angle θ relative to the upright member and a hook 230 attached to a rear surface 224 of the upright member 220. In one implementation, the angle θ is approximately 90 degrees (e.g., the horizontal member 210 is approximately orthogonal or perpendicular to the upright member 220). Each of the pair of brackets 200 is attached to one of the pair of jambs 22, 24 proximate a corner between the jamb 22, 24 and the sill 26 so that the hook 230 extends through a hole 25 in the jamb 22, 24, the upright member 220 is adjacent a surface 24*a* of the jamb 22, 24 and the horizontal member 210 is disposed above the top surface 26*a* of the sill 26.

Optionally the horizontal member 210 is spaced above the top surface 26*a* of the sill 26 (e.g., such that the horizontal member 210 is not in contact with the sill 26 and separated by a gap G). In one implementation, the horizontal member 210 is spaced approximately 1/16 inch above the top surface 26*a* of the sill 26. However, the horizontal member 210 can be spaced other suitable amounts above the top surface 26*a* of the sill 26 (e.g., between about 1/64 inch and about 1/8 inch, 1/64 inch, 1/32 inch, 1/8 inch, 0.03 inch).

With reference to FIGS. 8A-8G, in one implementation the horizontal member 210 of the bracket 200 can have a length L1 of approximately 1 inch and a width W1 of approximately 1 inch. However, in other implementations, the horizontal member 210 can have other suitable lengths L1 and/or widths W1. For example, in some implementations, the horizontal member 210 can have a width W1 of between approximately 3/4 inch and approximately 1 1/2 inch (e.g., 3/4 inch, 1 inch, 1 3/8 inch, etc.). In some implementations, the length L1 and width W1 can have the same dimension. In other implementations, the length L1 and width W1 can have different dimensions (e.g., the length L1 can be greater than the width W1, the width W1 can be greater than the length L1).

In one implementation, the upright or vertical member 220 of the bracket 200 can have a length L2 of approximately 1 inch and a width W2 of approximately 1 inch. However, in other implementations, the vertical member 220 can have other suitable lengths L2 and widths W2. In some implementations, the length L2 and width W2 can have the same dimension. In other implementations, the length L2 and width W2 can have different dimensions (e.g., the length L2 can be greater than the width W2, the width W2 can be greater than the length L2). The bracket 200 can have an opening 225 in the upright or vertical member 220 that can be used with tooling (e.g., to install the bracket 200). In the illustrated implementation, the opening 225 is a square shaped opening. However, in other implementations, the opening 225 can have other suitable shapes (e.g., rectangular, circular, oval).

In some implementations, the length L2 of the upright or vertical member 220 can have the same dimension as the length L1 of the horizontal member 210. In other implementations, the length L2 of the vertical member 220 can have a different dimension than the length L1 of the horizontal member 210 (e.g., the length L2 can be greater than the length L1, the length L2 can be smaller than the length L1). In some implementations, the width W2 of the upright or vertical member 220 can have the same dimension as the width W1 of the horizontal member 210. In other implementations, the width W2 of the vertical member 220 can have a different dimension than the width W1 of the horizontal member 210 (e.g., the width W2 can be greater than the width W1, the width W2 can be smaller than the width W1). In some implementations, the length L2 of the upright or vertical member 220 can remain the same (e.g., 1 inch) and the width W1 of the horizontal member 210 can vary (e.g., can be between approximately 3/4 inch and approximately 1 1/2 inch, such as 3/4 inch, 1 inch, 1 3/8 inch, etc.). For example, a kit of brackets 200 can be used for window assemblies 100 of varying sizes (e.g., having glass units 300 of varying thickness), each bracket 200 in the kit having the same height L2 for the upright member 220 but a different width W1 for the horizontal member 210.

The horizontal member 210 can have thickness D1 and the upright or vertical member 220 can have a thickness D2. In some implementations, the thickness D1 has the same dimension as the thickness D2. In other implementations, the thickness D1 has a different dimension than the thickness D2 (e.g., the thickness D2 is greater than the thickness D1, the thickness D2 is smaller than the thickness D1). In some implementations, the thickness D1 is approximately 1/8 inch. However, the thickness D1 can have other suitable dimensions (e.g., between about 1/64 inch and about 1/8 inch, 1/64 inch, 1/32 inch, 1/16 inch, 1/8 inch, 0.03 inch). In some implementations, the thickness D2 is approximately 1/8 inch. However, the thickness D2 can have other suitable dimensions (e.g., between about 1/64 inch and about 1/8 inch, 1/64 inch, 1/32 inch, 1/16 inch, 1/8 inch, 0.03 inch).

The hook 230 can optionally extend at an angle α relative to the rear surface 224 of the upright or vertical member 220. In one implementation, the angle α can be an acute angle. In some implementations, the angle α can be between about 20-70 degrees (e.g., 15 degrees, 30 degrees, 45 degrees, 60 degrees). In one implementation, the hook 230 (e.g., the angle α of the hook 230) advantageously inhibits (e.g., prevents) the bracket 200 from detaching from the jambs 22, 24. In other implementations, the hook 230 can have an upside down L or J shape.

The brackets 200 can advantageously support (e.g., bear) the load (e.g., substantially all of the weight, all of the weight) of the glass unit 300 and transfer the load (e.g. weight of the glass unit 300) to the pair of jambs 22, 24, which then transfer the weight of the glass unit 300 to the studs to (e.g., in the home) to which the jambs 22, 24 are attached (e.g., screwed). The brackets 200 can advantageously support a weight (e.g., weight of the glass unit 300) of up to approximately 350 lbs. (e.g., 200 lbs., 250 lbs., 300 lbs., 350 lbs., etc.). The pair of brackets 200 receive and support corners of the glass unit 300 (e.g., so that the corner of the glass unit 300 sits on the horizontal member 210 and adjacent the upright member 220 of the brackets 200). The pair of brackets 200 inhibit (e.g., prevent) the weight (e.g., a substantial portion of the weight, a majority of the weight, substantially all of the weight, the entire weight) of the glass unit 300 (e.g., insulated glass unit) from bearing on the sill 26, thereby advantageously inhibiting (e.g., preventing) the crushing or bowing (e.g., sagging) of the sill 26. Accordingly, the glass unit 300 is suspended relative to the sill 26. Advantageously, this inhibits (e.g., prevents) the formation of gaps in the window assembly 100 that allow for air and/or water infiltration through the window assembly 100.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Of course, the foregoing description is that of certain features, aspects and advantages of the present invention, to which various changes and modifications can be made without departing from the spirit and scope of the present invention. Moreover, the devices described herein need not feature all of the objects, advantages, features and aspects discussed above. Thus, for example, those of skill in the art will recognize that the invention can be embodied or carried out in a manner that achieves or optimizes one advantage or a group of advantages as taught herein without necessarily achieving other objects or advantages as may be taught or suggested herein. In addition, while a number of variations of the invention have been shown and described in detail, other modifications and methods of use, which are within the scope of this invention, will be readily apparent to those of skill in the art based upon this disclosure. It is contemplated that various combinations or subcombinations of these specific features and aspects of embodiments may be made and still fall within the scope of the invention. Accordingly, it should be understood that various features and aspects of the disclosed embodiments can be combined with or substituted for one another in order to form varying modes of the discussed devices.

What is claimed is:

1. A window assembly, comprising:

a polymer window frame having a pair of jambs and a sill extending between and interconnecting the pair of jambs at a pair of corners of the window frame;

a glass unit carried by the window frame; and a pair of brackets attached to the jambs proximate the pair of corners, each bracket comprising:

an upright member, a horizontal member substantially orthogonal to the upright member, and a hook attached to a rear surface of the upright member, wherein each of the brackets attaches to one of the jambs so that the hook extends through a hole in the jamb, the upright member is adjacent a surface of the jamb and the horizontal member is spaced above the sill, the brackets configured to support and transfer a weight of the glass unit to the jambs to suspend the glass unit relative to the sill, thereby inhibiting the sill from bearing an entire weight of the glass unit.

2. The window assembly of claim 1, wherein the brackets suspend the glass unit above the sill so that a gap is defined between the horizontal member of the brackets and the sill.

3. The window assembly of claim 2, wherein the gap is approximately 1/16 inch.

4. The window assembly of claim 1, wherein the hook extends at an acute angle relative to a rear surface of the upright member.

5. The window assembly of claim 1, wherein the horizontal member has a length of approximately 1 inch.

6. The window assembly of claim 1, wherein the horizontal member has a width of between about 1/4 inch and about 1 1/2 inch.

7. The window assembly of claim 1, wherein the window frame is made of vinyl.

8. The window assembly of claim 1, wherein the brackets are made of vinyl.

9. The window assembly of claim 1, wherein the brackets can support a load of up to approximately 350 lbs.

10. The window assembly of claim 1, wherein one or both of the horizontal member and the upright member of the brackets have a thickness of approximately 1/8 inch.

11. A window assembly, comprising:

a window frame having a pair of jambs and a sill extending between and interconnecting the pair of jambs at a pair of corners of the window frame;

a glass unit carried by the window frame; and one or more brackets attached to the jambs proximate the pair of corners, each bracket comprising:

an upright member, a horizontal member substantially orthogonal to the upright member, and a hook attached to a rear surface of the upright member, wherein each of the brackets attaches to one of the jambs so that the hook extends through a hole in the jamb, the upright member is adjacent a surface of the jamb and the horizontal member is spaced above the sill, the brackets configured to support and transfer a weight of the glass unit to the jambs to suspend the glass unit relative to the sill, thereby inhibiting the sill from bearing an entire weight of the glass unit.

12. The window assembly of claim 11, wherein the brackets suspend the glass unit above the sill so that a gap is defined between the horizontal member of the brackets and the sill.

13. The window assembly of claim 12, wherein the gap is approximately 1/16 inch.

14. The window assembly of claim 11, wherein the hook extends at an acute angle relative to a rear surface of the upright member.

15. The window assembly of claim 11, wherein the horizontal member has a length of approximately 1 inch.

16. The window assembly of claim 11, wherein the horizontal member has a width of between about 1/4 inch and about 1 1/2 inch.

17. The window assembly of claim 11, wherein the window frame is made of vinyl.

18. The window assembly of claim 11, wherein the brackets are made of vinyl.

19. The window assembly of claim 11, wherein the brackets can support a load of up to approximately 350 lbs.

20. The window assembly of claim 11, wherein one or both of the horizontal member and the upright member of the brackets have a thickness of approximately 1/8 inch.

* * * * *